US011544979B1

(12) United States Patent
Shen

(10) Patent No.: US 11,544,979 B1
(45) Date of Patent: Jan. 3, 2023

(54) MANAGEMENT METHOD FOR ELECTRONIC LOCKS

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 17/484,044

(22) Filed: Sep. 24, 2021

(30) Foreign Application Priority Data

Sep. 8, 2021 (TW) ..... 110133318

(51) Int. Cl.
*G07C 9/00* (2020.01)
*G07C 9/27* (2020.01)

(52) U.S. Cl.
CPC ..... *G07C 9/00857* (2013.01); *G07C 9/27* (2020.01); *G07C 2009/00865* (2013.01); *G07C 2209/02* (2013.01)

(58) Field of Classification Search
CPC ..... G07C 9/00857; G07C 9/27; G07C 2009/00865; G07C 2209/02
See application file for complete search history.

(56) References Cited

U.S. PATENT DOCUMENTS

2020/0327758 A1* 10/2020 Ma ..... H04M 1/72409

FOREIGN PATENT DOCUMENTS

EP 3550528 A1 * 10/2019 ..... E05B 17/0087
WO WO-2021050616 A1 * 3/2021 ..... G05B 19/0423
WO WO-2021214134 A1 * 10/2021 ..... G07C 9/00817

* cited by examiner

*Primary Examiner* — Nabil H Syed
(74) *Attorney, Agent, or Firm* — Alan D. Kamrath; Karin L. Williams; Mayer & Williams PC

(57) ABSTRACT

A management method for electronic locks includes obtaining a manager mobile device with management authorities of a plurality of locks. The manager mobile device can be connected any one of the plurality of locks, and the lock connected to the manager mobile device switches to a writing mode. The lock connected to the manager mobile device writes the unlocking authority of at least one of the plurality of locks into a door access card. When the door access card is identified by one of the plurality of locks as being correct, the one of the plurality of locks is unlocked.

16 Claims, 2 Drawing Sheets

MANAGEMENT METHOD FOR ELECTRONIC LOCKS

BACKGROUND OF THE INVENTION

The present invention relates to a management method for electronic locks and, more particularly, to a method using a lock to directly write an authorization information into a door access card.

An electronic door lock currently available on the market can be unlocked by induction between a door access card and the electronic door lock using radio frequency identification (RFID) technology. Specifically, when the door access card is near the electronic door lock, the information contained in the door access card can be accessed by the electronic door lock. The electronic door lock is unlocked when the information is correct. On the other hand, the electronic door lock remains in the locked state when the information is incorrect.

Taking a hotel as an example, for unlocking all or specific electronic door locks, the door access card must be authorized by the management server end cooperation with a card reader. The management server may be installed at a reception desk and a hotel staff member can give the door access card to a customer after authorization operation of the door access card is completed. Thus, the customer can use the door access card to unlock an electronic door lock of a door of a room of the hotel.

BRIEF SUMMARY OF THE INVENTION

In a first aspect, a management method for electronic locks according to the present invention includes:

obtaining a manager mobile device with a management authority of a first lock, with the manager mobile device entering a management mode interface;

connecting the manager mobile device entered the management mode interface with the first lock in an identification mode;

using the manager mobile device to select the first lock as a lock whose unlocking authority is to be granted, with the selection being carried out through the management mode interface;

outputting a writing command from the manager mobile device to the first lock, with the first lock entering a writing mode after receiving the writing command;

connecting a door access card with the first lock;

using the first lock in the writing mode to write the unlocking authority of the first lock into the door access card, granting the unlocking authority of the first lock to the door access card;

disconnecting the manager mobile device from the first lock, with the manager mobile device exiting the management mode interface and entering a non-management mode;

disconnecting the door access card from the first lock, with the first lock entering an identification mode; and connecting the door access card with the first lock in the identification mode, wherein the first lock is unlocked when the first lock identifies the door access card as being correct, and wherein the first lock remains in a locked state when the first lock identifies the door access card as being incorrect.

By connecting the manager mobile device entering the manager mode interface with a lock, the lock can write its unlocking authority into a door access card. Thus, when handing unlocking authority of the door access card, the lock can replace a card reader to cancel or grant the unlocking authority without the need of returning to the server end.

In an example, the method further includes using the first lock to read and store a door access card identification information of the door access card during or after writing the unlocking authority into the door access card in connection with the first lock in the writing mode. Then, the door access card identification information is transmitted to a server for storage.

In an example, the door access card identification information is transmitted to the server by one of the manager mobile device and the first lock.

In an example, the identification of the door access card by the first lock includes reading the unlocking authority and the door access card identification information in the door access card. The first lock is unlocked when the first lock identifies both of the unlocking authority and the door access card identification information as being correct. The first lock remains in the locked state when the first lock identifies at least one of the unlocking authority and the door access card identification information as being incorrect.

In an example, using the first lock to write the unlocking authority of the first lock into the door access card includes writing a hardware identification information related to and stored in the first lock into the door access card, or writing the hardware identification information related to and stored in the first lock as well as a start date, a start time, an end date, and an end time of the unlocking authority into the door access card.

In an example, after the manager mobile device in the non-management mode is connected to the first lock in the identification mode, the first lock in the identification mode reads and identifies the unlocking authority of the manager mobile device in the non-management mode. The first lock is unlocked when the first lock in the identification mode identifies the manager mobile device as being correct. The first lock remains in the locked state when the first lock in the identification mode identifies the manager mobile device as being incorrect.

In an example, the method further includes logging in a server; connecting the door access card with a card reader at the server; and writing the unlocking authority of the selected lock into the door access card through use of an interface of the server, or cancelling the unlocking authority of the selected lock from the door access card through use of the interface of the server.

In an example, the method further includes:

using the manager mobile device entering the management mode interface to select an unlocking authority of a to-be-canceled door access card, wherein the selected unlocking authority of the to-be-canceled door access card is to be canceled;

connecting the manager mobile device with the first lock in the identification mode, with the manager mobile device outputting an unlocking authority-cancelling command related to the selected unlocking authority of the to-be-canceled door access card to the first lock, and with the first locking switching to the writing mode;

connecting the to-be-canceled door access card to the first lock in the writing mode;

using the first lock in the writing mode to cancel the selected unlocking authority from the to-be-canceled door access card;

disconnecting the first lock from the manager mobile device and the door access card whose unlocking authority has been canceled; and switching the first lock to the identification mode.

In a second aspect, a management method for electronic locks according to the present invention includes:

obtaining a manager mobile device with management authorities of a first lock and a second lock, with the manager mobile device entering a management mode interface;

connecting the manager mobile device entered the management mode interface with one of the first and the locks in an identification mode;

using the manager mobile device to select at least one of the first and second locks as a lock whose unlocking authority is to be granted, with the selection being carried out through the management mode interface;

outputting a writing command from the manager mobile device to the one of the first and second locks connected to the manager mobile device, wherein the one of the first and second locks enters a writing mode after receiving the writing command;

connecting a door access card with the one of the first and second locks in the writing mode;

using the one of the first and second locks in the writing mode to write at least one of the unlocking authority of the first lock and the unlocking authority of the second lock into the door access card, granting at least one of the unlocking authorities of the first and second locks to the door access card;

disconnecting the manager mobile device from the one of the first and second locks in the writing mode, with the manager mobile device exiting the management mode interface and entering a non-management mode;

disconnecting the door access card from one of the first and second locks, with the one of the first and second locks switching from the writing mode to an identification mode; and connecting the door access card with the one of the first and second locks in the writing mode in the identification mode, wherein the one of the first and second locks is unlocked when the one of the first and second locks in the writing mode identifies the door access card as being correct, and wherein the one of the first and second locks remains in a locked state when the one of the first and second locks in the writing mode identifies the door access card as being incorrect.

In an example, the method further includes using the one of the first and second locks to read and store a door access card identification information of the door access card during or after writing at least one of the unlocking authority of the first lock and the unlocking authority of the second lock into the door access card in connection with the one of the first and second locks in the writing mode. Then, the door access card identification information is transmitted to a server for storage.

In an example, the identification of the door access card by the one of the first and second locks includes reading the unlocking authority and the door access card identification information in the door access card. The one of the first and second locks is unlocked when the one of the first and second locks identifies both of the unlocking authority and the door access card identification information as being correct. The one of the first and second locks remains in the locked state when the one of the first and second locks identifies at least one of the unlocking authority and the door access card identification information as being incorrect.

In an example, the door access card identification information of the door access card granted with at least one of the unlocking authority of the first lock and the unlocking authority of the second lock is transmitted to the server by one of the manager mobile device and the one of the first and second locks.

In an example, each of the first and second locks stores a first hardware identification information of the first lock and a second hardware identification information of the second lock. The first hardware identification information is different from the second hardware identification information. While the one of the first and second locks is writing at least one of the unlocking authorities of the first and second locks into the door access card, the one of the first and second locks writes at least one of the first and second hardware identification informations of the first and second locks into the door access card.

In an example, a first hardware identification information of the first lock and a second hardware identification information of the second lock are stored in a server. When the one of the first and second locks connected to the manager mobile device does not include one of the first and second hardware identification informations of the selected lock whose unlocking authority is to be granted, the manager mobile device is connected to the server to obtain the one of the first and second hardware identification informations of the selected lock. The writing command outputted by the manager mobile device includes the one of the first and second hardware identification informations of the selected lock. Writing the unlocking authority into the door access card includes writing the one of the first and second hardware identification informations of the selected lock into the door access card.

In an example, after the manager mobile device in the non-management mode is connected to the one of the first and second locks in the identification mode, the one of the first and second locks in the identification mode reads and identifies the unlocking authority of the manager mobile device in the non-management mode. The one of the first and second locks is unlocked when the one of the first and second locks in the identification mode identifies the manager mobile device as being correct. The one of the first and second locks remains in the locked state when the one of the first and second locks in the identification mode identifies the manager mobile device as being incorrect.

In an example, the method further includes:

using the manager mobile device entering the management mode interface to select at least one unlocking authority of a to-be-canceled door access card, wherein the selected at least one unlocking authority of the to-be-canceled door access card is to be canceled;

connecting the manager mobile device with the one of the first and second locks in the identification mode, with the manager mobile device outputting an unlocking authority-cancelling command related to the selected at least one unlocking authority of the to-be-canceled door access card to the one of the first and second locks in the identification mode, and with the one of the first and second locks in the identification mode switching to the writing mode after receiving the unlocking authority-cancelling command;

connecting the to-be-canceled door access card to the one of the first and second locks in the writing mode;

using the one of the first and second locks in the writing mode to cancel the selected at least one unlocking authority from the to-be-canceled door access card;

disconnecting the one of the first and second locks in the writing mode from the manager mobile device and the door access card whose unlocking authority has been canceled; and switching the one of the first and second locks to the identification mode.

In an example, the method further includes: logging in a server; connecting the door access card with a card reader at the server; and writing the unlocking authority of the selected lock into the door access card through use of an interface of the server, or cancelling the unlocking authority of the selected lock from the door access card through use of the interface of the server.

In an example, using the one of the first and second locks to write at least one of the unlocking authorities of the first and second locks into the door access card includes writing at least one of the first and second hardware identification informations stored in at least one of the first and second locks into the door access card, or writing at least one of the first and second hardware identification informations stored in at least one of the first and second locks into the door access card as well as a start date, a start time, an end date, and an end time of the unlocking authority of at least one of the first and second locks into the door access card.

The present invention will become clearer in light of the following detailed description of illustrative embodiments of this invention described in connection with the drawings.

DETAILED DESCRIPTION OF THE INVENTION

Figure 1:
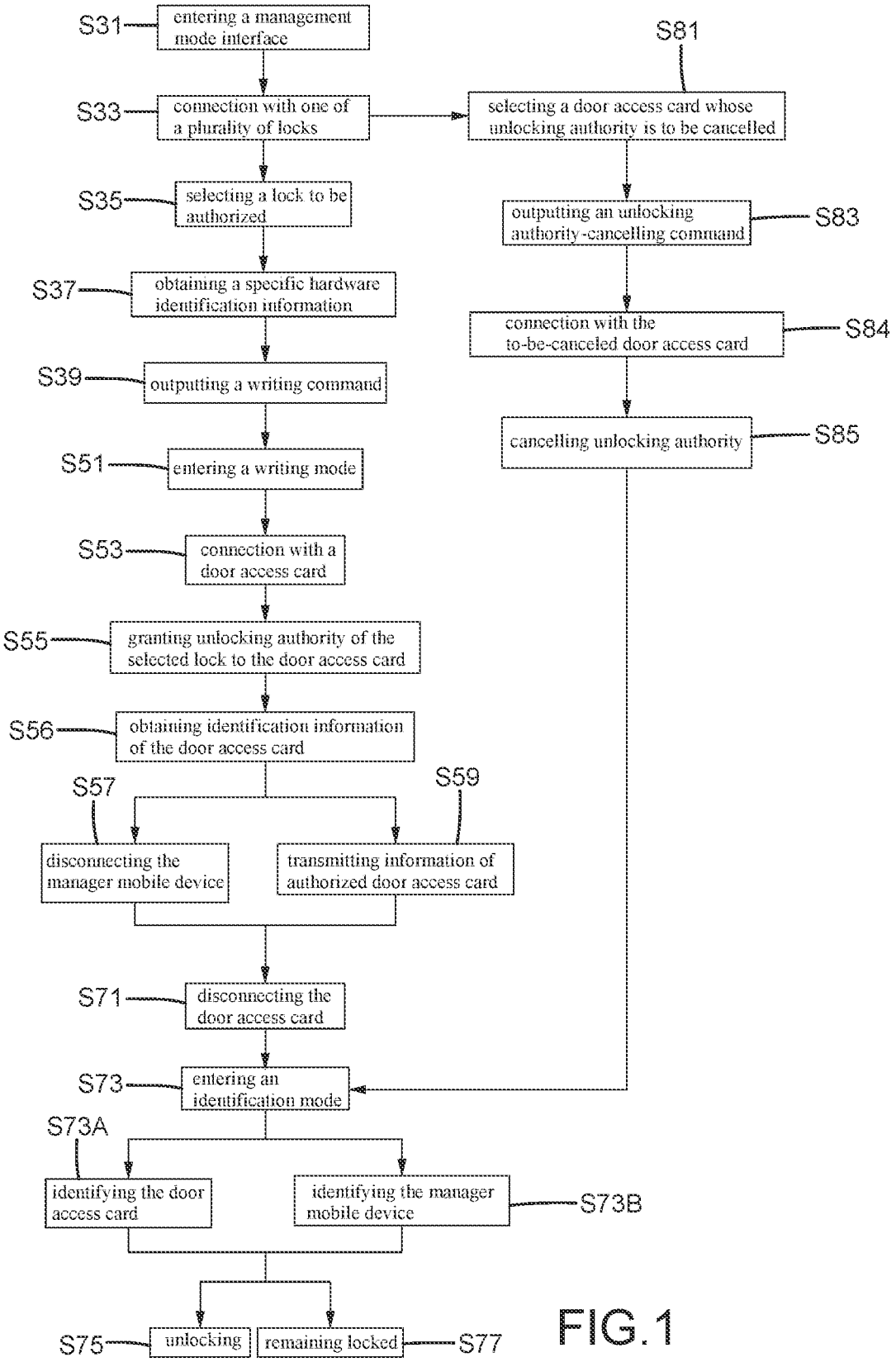
FIG. 1 is a flowchart showing an embodiment of a management method for electronic locks according to the present invention.

FIG. 1 shows a flowchart showing an embodiment of a management method for electronic locks according to the present invention. In this embodiment, a manager mobile device is used to enter a management mode interface (hereinafter referred to as "the interface") (step S31). The manager mobile device has obtained management authorities of a first lock and a second lock. Note that the manager mobile device can obtain management authorities of a plurality of locks. The manager mobile device enters a non-management mode after exiting the management mode interface.

For ease of explanation, the embodiment of the present invention merely includes the first lock and the second lock. Nevertheless, the method according to the present invention is not limited to the case involving only one or two locks. Furthermore, a plurality of manager mobile devices corresponding to different management levels can be used. For example, a manager mobile device of the highest management level can control the management authority of all rooms, whereas a manager mobile device of a lower management level can control the management authority of fewer rooms.

The term "management authority" used herein relates to the authority of granting and cancelling authority (such as unlocking authority) to another device (such as a door access card or another mobile device). Furthermore, there are various ways for the manager mobile device to obtain the management authorities of the first and second locks. As an example, keys related to management authority can be installed in the first and second locks. After housings of the first and second locks are removed, the keys can be pressed to grant the management authority to a mobile device and turn the mobile device into a manager mobile device. Note that the method for granting the management authority to the manager mobile device is intended to assist in understanding the technical features of the present invention and should not be used to restrict the scope of the present invention.

The manager mobile device can enter the interface through a lock management application (hereinafter referred to as "the APP"). The interface lists all locks (the first and second locks in this embodiment) whose management authorities are controlled by the manager mobile device.

After entering the interface, the manager mobile device can be connected to one of the first lock and the second lock (step S33). Specifically, the manager mobile device entering the interface can be connected to one of the first lock and the second lock, which is nearer to the manager mobile device and within a communication range. In a case that the manager mobile device is nearer to the first lock and the distance between the manager mobile device and the first lock is within a communication range, the manager mobile device entering the interface is connected to the first lock. In another case that the manager mobile device is nearer to the second lock and the distance between the manager mobile device and the second lock is within a communication range, the manager mobile device entering the interface is connected to the second lock. Namely, regardless of the location of the manager mobile device, the manager mobile device entering the interface will be automatically connected to the nearest lock within the communication range. The manager mobile device can be connected to the first or second lock by Bluetooth or Wi-Fi.

Next, in step S35, the manager mobile device is used to select at least one of the locks as the lock or locks whose unlocking authority can be subsequently granted to another device. Specifically, after the manager mobile device enters the interface, icons representing all locks (whose management authorities can be controlled by the manager mobile device) are shown on the interface controlled by the APP (such as through connection with the server). The manager mobile device can be used to select at least one of the locks by clicking the associated icon(s) on the interface. In this embodiment, the manager can click at least one of two icons (representing the first and second locks) on the interface. In a case that the manager mobile device only has the management authority of the second lock, only the icon representing the second lock is shown on the interface. The term "selected lock" or "selected locks" refers to the lock or locks selected by the manager mobile device, and the unlocking authority of the selected lock or the unlocking authorities of the selected locks can be subsequently granted to another device.

Note that the manager mobile device can be connected to other locks whose management authorities cannot be controlled by the manager mobile device. In a case that the manager mobile device only has the management authority of the second lock, when the manager mobile device entering the interface is connected to either of the first lock and the second lock, the interface controlled by the APP only shows the icon representing the second lock.

Note that the unlocking authority can include a specific hardware identification information for a respective lock. For example, the hardware identification information of the first lock can be different from that of the second lock. Furthermore, the unlocking authority can be encrypted. In step S37, the hardware identification information(s) of the selected lock(s) is/are obtained.

In an embodiment, the specific hardware identification informations of the first and second locks can be stored in the memories respectively of the first and second locks. Namely, the first lock only stores the hardware identification information of the first lock, and the second lock only stores the hardware identification information of the second lock. Alternatively, the hardware identification informations of the first and second locks can be stored in the memories of both the first and second locks.

In an alternative embodiment, the hardware identification informations of the first and second locks can be stored in a server instead of the first and second locks. Since the first lock or the second lock connected to the manager mobile device does not have its specific hardware identification information, the manager mobile device is connected to the server to obtain the hardware identification information of the selected lock(s).

All locks listed on the interface and controlled by the manager mobile device can be obtained through connection with the server.

After selection of the locks, the manager mobile device outputs a writing command to the first lock or the second lock connected to the manager mobile device (step S39). Specifically, when the manager is connected to the first lock, the manager mobile device outputs a writing command to the first lock. Alternatively, when the manager is connected to the second lock, the manager mobile device outputs a writing command to the second lock.

In a case that the first or second lock connected to the manager mobile device does not include the hardware identification information of the selected lock, the step of outputting the writing command includes obtaining the hardware identification information of the selected lock from the server. As an example, the manager mobile device is connected to the first lock and the second lock is the selected lock, when the first lock does not include the hardware identification information of the second lock, the manager mobile device obtains the hardware identification information of the second lock from the server and sends the hardware identification information of the second lock to the first lock for temporary storage.

In another case, the first or second lock connected to the manager mobile device includes the hardware identification information of the selected lock, the manager mobile device does not have to obtain the hardware identification information of the selected lock from the server. Furthermore, the writing command from the manager mobile device does not include obtaining the hardware identification information of the selected lock from the server. In an example, the manager mobile device is connected to the first lock and the second lock is the selected lock. The first lock stores the hardware identification information of the second lock, such that the writing command from the manager mobile device does not include the hardware identification information of the second lock.

After the writing command from the manager mobile device is sent to the first or second lock, the first or second lock receiving the writing command enters a writing mode (step S51). Specifically, the first or second lock remains in an identification mode before receiving the writing command. The identification mode is used to identify whether a door access card (with unlocking authority) connected to the lock or a mobile device (with unlocking authority, such as the manager mobile device or another mobile device with unlocking authority) connected to the lock is correct. The writing command can only be received by the lock connected to the manager mobile device. Thus, the first or second lock switches from the identification mode to the writing mode after reception of the writing command. The second or first lock not receiving the writing command still remains in the identification mode. When the first or second mode entering the writing mode is connected to the door access card, the first or second lock will not identify whether the door access card is correct.

After the first or lock enters the writing mode, a door access card is connected to the first or second lock in the writing mode (step S53). For example, the first lock receiving the writing command from the manager mobile device enters the writing mode, and a to-be-authorized door access card is needed to connect with the first lock in the writing mode.

The door access card can use radio frequency identification (RFID) technology. Thus, the connection between the door access card and the first lock can be established when the door access card is near a wireless transmitter of the first lock. In this state, the first lock is connected to both the manager mobile device and the door access card. For example, the manager mobile device and the first lock are connected by Bluetooth, whereas the first lock and the door access card are connected by RFID.

After the door access card is connected to the first or second lock in the writing mode, the first or second card in the writing mode writes the unlocking authority of at least one of the first and second locks (including the hardware identification information of the first and/or second locks) into the door access card. Thus, the door access card is granted the unlocking authority of at least one of the first and second locks (step S55).

In a case that the door access card is connected to the first lock in the writing mode and the second lock is the selected lock, the first lock writes the unlocking authority of the second lock into the door access card. In another case that the door access card is connected to the first lock in the writing mode and the first lock is the selected lock, the first lock writes the unlocking authority of the first lock into the door access card. In a further case that the door access card is connected to the second lock in the writing mode and both the first and second locks are the selected locks, the second lock writes the unlocking authorities of the first and second locks into the door access card.

It can be appreciated that the unlocking authority can include other informations, such as the start date, start time, end date, and end time of authority, such that the unlocking authority of the door access card is valid only during the predetermined period of time.

After the unlocking authority of the selected lock is written into the door access card, the manager mobile device is disconnected from the first or second lock and exits the interface (step S57). For example, after the unlocking authority is written into the door access card, the manager mobile device can be disconnected from the first lock by operating the interface. After the first lock in the writing mode is disconnected from the manager mobile device, the manager mobile device exits the interface and enters the non-management mode.

After the door access card obtains the unlocking authority of the selected lock, the information of the authorized door access card is transmitted back to the server for storage (step S59).

There are variations of transmission of the information of the door access card to the server in response to different hardware dispositions. In a case that the first and second locks cannot be directly connected to the server, while the first or second lock is writing the unlocking authority into the door access card, the first or second lock reads door access card identification information (such as the identification number of the door access card), stores the door access card identification information into the memory, and transmits the door access card identification information to the manager mobile device. Then, the manager mobile device transmits the door access card identification information to the server through Wi-Fi or global system for mobile communication (GSM). In another case that the first and second locks can be directly connected to the server, while the first or second lock is writing the unlocking authority into the door access card, the first or second lock reads the door access card identification information (such as the identification number of the door access card), stores the door access card identification information into the memory, and transmits the door access card identification information to the manager mobile device for storage.

The information of the door access card transmitted to the server includes the door access card identification information, the unlocking authority granted to the door access card, and the contents of the unlocking authority. For example, the unlocking authority of the second lock granted to the door access card includes the start date, start time, end date, and end time of authority Namely, during transmission of the information of the authorized door access card, the unlocking authority (including the start date, start time, end date, and end time of unlocking authority of the second lock) granted to the door access card and the door access card identification information are together transmitted back to the server.

In a case that another door access card is granted the unlocking authorities of the first and second locks without setting the start date, start time, end date, and end time of authority, transmission of the information of the authorized door access card includes transmitting the unlocking authorities of the first and second locks granted to the door access card and the door access card identification information of the door access card to the server. Thus, the server can record the unlocking authority of each door access card as well as whether the unlocking authority is limited.

After the door access card is granted with the unlocking authority, the door access card is disconnected from the first or second lock (step S71), and the first or second lock in the writing mode enters the identification mode (step S73). Specifically, in an example, after the unlocking authority is written into the door access card connected to the first lock in the writing mode, the door access card is moved away from the first lock. When the distance between the door access card and the first lock is larger than the maximum communication range, the door access card is in an offline state and, thus, cannot be connected to the first lock. For example, the door access card and the first lock become oline when the distance therebetween is larger than 10 cm when the door access card uses RFID technology. After the first lock in the writing mode is disconnected from the door access card and the manager mobile device, the first lock switches from the writing mode to the identification mode. In another example, after the second lock in the writing mode is disconnected from the door access card and the manager mobile device, the second lock switches from the writing mode to the identification mode.

The door access card granted with the unlocking authority can be used as an electronic key for unlocking the first lock and/or the second lock in the identification mode. Specifically, when the door access card is connected to the first or second lock in the identification mode and the first or second lock identifies the door access card as being correct (step S73A), the first or second lock is unlocked (step S75). On the other hand, when the first or second card in the identification mode identifies the door access card as being incorrect (S73A), the first or second lock remains unlocked (step S77).

Identification of the door access card by the first or second lock can have carious approaches. In a first type of identification, the first lock reads the unlocking authority of the door access card, and the first lock compares its specific hardware identification information with the hardware identification information contained in the unlocking authority of the door access card. When the hardware identification information of the first lock matches with the hardware identification information contained in the unlocking authority of the door access card, the door access card is successfully identified as being correct, and the first lock is unlocked. On the other hand, when the hardware identification information of the first lock does not match with the hardware identification information contained in the unlocking authority of the door access card, identification of the door access card fails, and the first lock remains in the locked state.

In an example in which the door access card is granted with the unlocking authority of the first lock, the hardware identification information of the first lock is stored in the door access card. In this state, when the door access card is connected to the second lock in the identification mode, the second lock in the identification mode obtains the unlocking authority of the door access card and then identifies the hardware identification information of the first lock. Since the hardware identification information of the first lock does not match with the hardware identification information of the second lock, identification of the door access card fails, and the second lock in the identification mode remains in the locked state. Furthermore, identification of the door access card will fail when the second lock does not store the door access card identification information of the door access card.

In a second type of identification, the door access card identification information of the door access card is stored in the first lock. The first lock reads the unlocking authority and the door access card identification information of the door access card. The first lock compares its own hardware identification information with the hardware identification information contained in the unlocking authority of the door access card and compares the door access card identification information of the door access card with the door access card identification information stored in the first lock. The first lock is unlocked only when the hardware identification information of the first lock matches with the hardware identification information contained in the unlocking authority of the door access card and the door access card identification information of the door access card matches with the door access card identification information stored in the first lock. The first lock remains in the locked state when the hardware identification information of the first lock does not match with the hardware identification information contained in the unlocking authority of the door access card and/or the door access card identification information of the door access card does not match with the door access card identification information stored in the first lock.

Furthermore, in an example, the unlocking authority of the door access card includes the start date, start time, end date, and end time. During identification of the door access card, the door access card is identified as being correct when the time of identification is within a valid time period between the start date and time and the end date and time and when the unlocking authority is identified as being correct. On the other hand, identification of the door access card fails when the time of identification is outside of the valid time period between the start date and time and the end date and time even if the unlocking authority is correct.

In addition to connection between the authorized door access card and the first or second lock in the identification mode for identification purposes (for deciding whether to unlock), the manager mobile device in the non-management mode can also serve for identifying the first or second lock in connection with the manager mobile device. Namely, the unlocking authority of the first lock and/or the second lock is/are stored in the manager mobile device.

Specifically, after the manager mobile device in the non-management mode interface is connected to the first or second lock in the identification mode, the first or second lock reads and identifies the unlocking authority of the manager mobile device in the non-management mode interface (step S73B). The first or second lock is unlocked when the first or second lock in the identification mode identifies the manager mobile device as being correct (step S75). On the other hand, when the first or second lock in the identification mode identifies the manager mobile device as being incorrect, the first or second lock remains in the locked state (step S77).

Furthermore, the embodiment of the method according to the present invention can cancel the unlocking authority of the authorized door access card, such that the door access card loses the unlocking authority of all or a portion of the plurality of locks. Specifically, the interface of the manager mobile device can be used to select the door access card whose the unlocking authority is to be canceled (step S81).

Specifically, in an example in which a door access card is granted with the unlocking authority of the first lock, when the manager mobile device enters the interface, the interface shows the information of all of authorized door access cards. Thus, the door access card (whose unlocking authority is to be canceled) can be selected from the interface through selection. Then, the unlocking authority of the first lock can be canceled from the selected door access card. The manager mobile device can be optionally connected to the first or second lock in the identification mode.

During or after using the manager mobile device to select at least one door access card (whose unlocking authority is to be canceled), the manager mobile device is connected to the first or second lock in the identification mode. Then, the manager mobile device outputs an unlocking authority-cancelling command to the first or second lock connected to the manager mobile device and in the identification mode (step S83). The first or second lock switches from the identification mode to the writing mode after receiving the unlocking authority-cancelling command.

Namely, after selecting at least one door access card whose unlocking authority is to be canceled, the manager mobile device is connected to a lock selected optionally. In a case that the unlocking authority of the first lock is to be canceled from a door access card, the interface of the manager mobile device is used to select the door access card. Then, the manager mobile device is connected to the first or second lock in the identification mode (step S84) and transmits the unlocking authority-cancelling command to the first or second lock connected to the manager mobile device and in the identification mode. Next, the first or second lock switches from the identification mode to the writing mode after receiving the unlocking authority-cancelling command.

After the manager mobile device outputs the unlocking authority-cancelling command to the first or second lock, the first or second lock in the writing mode cancels the unlocking authority from the door access card connected to the first or second lock (step S85). Then, the first or second lock in the writing mode is disconnected from the manager mobile device and the door access card and enters the identification mode.

In a case that the unlocking authority of the second lock is to be cancelled from a door access card having the unlocking authorities of the first and second locks, the manager mobile device and the door access card are connected to the first lock in the writing mode. When the first card in the writing mode receives the unlocking authority-cancelling command, the unlocking authority of the second lock is canceled from the door access card but the unlocking authority of the first lock is kept. After cancelling the unlocking authority of the second lock from the door access card, the manager mobile device and the door access card are disconnected from the first lock, and the first lock switches from the writing mode to the identification mode.

Since the unlocking authority of the first lock is kept in the door access card after the unlocking authority of the second lock is canceled, the door access card can still be used to unlock the first lock but not the second lock.

In another case that the unlocking authorities of the first and second locks are to be cancelled from a door access card having the unlocking authorities of the first and second locks, the manager mobile device and the door access card are connected to the first lock in the writing mode. When the first card in the writing mode receives the unlocking authority-cancelling command, the unlocking authorities of the first and second locks are canceled from the door access card. After cancelling the unlocking authorities of the first and second locks from the door access card, the manager mobile device and the door access card are disconnected from the first lock, and the first lock switches from the writing mode to the identification mode. Since the unlocking authorities of the first and second cards are cancelled, the door access card is substantially invalid and, thus, cannot be used to unlock the first and second locks.

Figure 2:
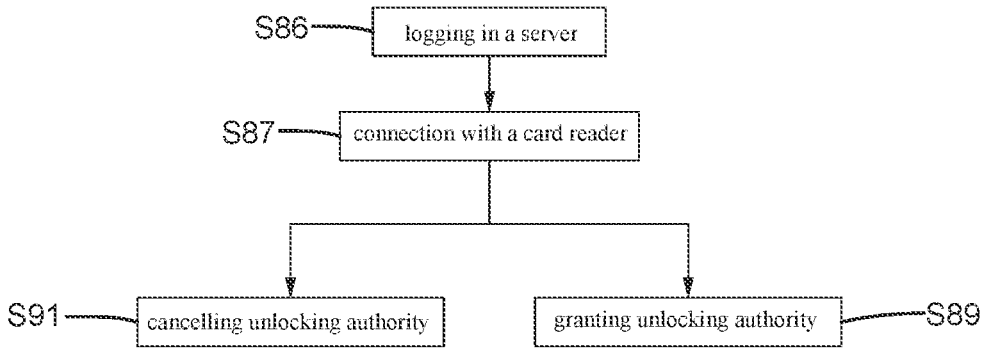
FIG. 2 is a flowchart showing cancellation or granting of unlocking authority by logging in a server cooperating with a card reader.

There are other alternative approaches for granting and cancelling unlocking authorities in the embodiment of the method according to the present invention. For example, a customer can return the door access card of a room of a hotel to a receptionist. The receptionist can log in a sever (step S86 in FIG. 2) and can connect the door access card with a card reader at the server (step S87 in FIG. 2).

Specifically, in addition to using the manager mobile device to grant or cancel the unlocking authority, the server and the card reader can be used to grant the unlocking authority to the door access card or cancel the unlocking authority from the door access card.

For example, after checking the identity of a customer reporting to the reception desk, the receptionist logs in the server and connects a door access card without any unlocking authority to a card reader, establishing the connection. Then, the unlocking authority of a lock of a door of a room can be written into the door access card through use of an interface of the server (step 89 in FIG. 2).

Specifically, in a case that the receptionist has checked the identity of the customer and the booked room, a door access card without any unlocking authority can be connected to the card reader while logging in the server. The interface of the server can be used to select the unlocking authority of the lock of the booked room. The unlocking authority of the lock of the booked room can be written into the door access card through the card reader, such that the customer can use the door access card to unlock the lock of the booked room. Note that the lock (such as the first lock) of the booked room remains in the identification mode (and will not switch to the writing mode) while the server and the card reader are used to write the unlocking authority into the door access card.

The door access card will be returned to the reception desk after the customer checks out. The receptionist can use a computer at the reception desk to log in the server and can connect the door access card to a card reader, establishing the connection. Then, the unlocking authority of the lock of the room can be canceled from the door access card through use of the interface of the server (step S91 in FIG. 2).

Specifically, after logging in the server and connecting the door access card with the card reader, the unlocking authority of the door access card can be known from the interface of the server. For example, the door access card held by the customer has the unlocking authority of the first lock. Thus, the interface of the server can be used to select the unlocking authority of the first lock to be canceled from the door access card. Then, the card reader at the server can be used to cancel the unlocking authority of the first lock. Note that the lock (such as the first lock) of the room remains in the identification mode (and will not switch to the writing mode) while the server and the card reader are used to cancel the unlocking authority from the door access card.

To assist in understanding of the technical features of the present invention, it is assumed that a manager mobile device obtains the unlocking authorities of the first and second locks, the first lock has a first hardware identification information, the second lock has a second hardware identification information different from the first hardware identification information, and the first and second locks are not connected to the server. When the unlocking authorities (without time limit) of the first and second locks are to be granted to the door access card, the manager mobile device enters the manager mobile interface and is optionally connected to the first lock. Then, the unlocking authorities of the first and second locks are selected from the interface of the manager mobile device. Since the first lock does not include the second hardware identification information of the second lock, the manager mobile device obtains the second hardware identification information of the second lock from the server end. The manager mobile device outputs a writing command (containing the second hardware identification information of the second lock) to the first lock. After receiving the writing command, the first lock switches to the writing mode and temporarily stores the second hardware identification information of the second lock.

Next, the door access card is connected to the first lock in the writing mode. The first lock in the writing mode reads the door access card identification information of the door access card and transmits the door access card identification information of the door access card to the manager mobile device. In response to the writing command, the first lock in the writing mode writes the first hardware identification information of the first lock and the temporarily stored second hardware identification information of the second lock into the door access card. The second hardware identification information of the second lock temporarily stored in the first lock is canceled from the first lock after the second hardware identification information of the second lock is written into the door access card. The manager mobile device transmits the information (containing the door access card identification information and the unlocking authorities of the door access card) back to the server. Furthermore, the first lock switches to the identification mode after the manager mobile device and the door access card are disconnected from the first lock in the writing mode. Thus, the door access card is granted with the unlocking authorities of the first and second cards.

Trough connection between the lock(s) (the first lock and/or the second lock) and the manager mobile device entering the management mode interface, the lock(s) can be used to write the unlocking authority of the lock(s) into the door access card. Thus, each lock can replace the card reader to write or cancel the unlocking authority. As a result, the personnel can handle the granting operation of the unlocking authority without returning to the server end. As an example, when a customer holding an authorized door access card (given by a hotel staff member) comes to a room but cannot unlock the lock of the room by the door access card, the customer can inform the hotel staff member by telephone. The hotel staff member can go to the room and use the manager mobile device to write the unlocking authority into the door access card. As can be seen from this example, the customer does not have to go to the server at the reception desk and then go back to the room, and the hotel staff member can solve the problem of the door access card without the need of returning to the server end for solving the problem of the door access card and then personally sending the corrected door access card to the customer.

The server stores the hardware identification informations of all locks, such that the management mobile device entering the management mode interface can select any lock to grant the unlocking authority of the lock. The unlocking authority of the selected lock including the specific hardware identification information of the lock can be directly obtained from the server, such that the manager mobile device can select any lock to proceed with granting of the unlocking authority, increasing the use convenience.

Now that the basic teachings of the present invention have been explained, many extensions and variations will be obvious to one having ordinary skill in the art. For example, the method does not have to include the step of obtaining the identification information of the door access card (step S56). In this case, the lock can still be unlocked or remains in the locked state by identifying whether the unlocking authority written into the door access card is correct. Furthermore, when it is desired to cancel the unlocking authority of the door access card, the unlocking authority can be deleted from the door access card, or the start date, start time, end date, and end time of the unlocking authority of the door access card can be set, such that the door access card loses the unlocking authority when the door access card is not used within the valid time period.

Alternatively, the manager mobile device can write the unlocking authority into the door access card without connection with the server. Specifically, given the manager mobile device not in connection with the server, the hardware identification information of each lock is stored in its own memory. When the manager mobile device is connected to one of the locks, the connected lock can write its own hardware identification information into the door access card, thereby granting the unlocking authority to the door access card. In a case that the unlocking authority of a plurality of locks is to be granted, the manager mobile device can be used to connect with the plurality of locks one by one.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A management method for electronic locks, comprising:

obtaining a manager mobile device with a management authority of a first lock, entering the manager mobile device in a management mode interface;

connecting the manager mobile device entered the management mode interface with the first lock in an identification mode;

using the manager mobile device to select the first lock as a lock whose unlocking authority is to be granted, with the selection being carried out through the management mode interface;

outputting a writing command from the manager mobile device to the first lock, with the first lock entering a writing mode after receiving the writing command;

connecting a door access card with the first lock;

using the first lock in the writing mode to write the unlocking authority of the first lock into the door access card, granting the unlocking authority of the first lock to the door access card;

disconnecting the manager mobile device from the first lock, with the manager mobile device exiting the management mode interface and entering a non-management mode;

disconnecting the door access card from the first lock, with the first lock entering an identification mode;

connecting the door access card with the first lock in the identification mode, wherein the first lock is unlocked when the first lock identifies the door access card as being correct, and wherein the first lock remains in a locked state when the first lock identifies the door access card as being incorrect;

using the manager mobile device entering the management mode interface to select an unlocking authority of a to-be-canceled door access card, wherein the selected unlocking authority of the to-be-canceled door access card is to be canceled;

connecting the manager mobile device with the first lock in the identification mode, with the manager mobile device outputting an unlocking authority-cancelling command related to the selected unlocking authority of the to-be-canceled door access card to the first lock, and with the first lock switching to the writing mode;

connecting the to-be-canceled door access card to the first lock in the writing mode; using the first lock in the writing mode to cancel the selected unlocking authority from the to-be-canceled door access card; and disconnecting the first lock from the manager mobile device and the door access card whose unlocking authority has been canceled; and switching the first lock to the identification mode.

2. The management method for electronic locks as claimed in claim 1, further comprising:

using the first lock to read and store a door access card identification information of the door access card during or after writing the unlocking authority into the door access card in connection with the first lock in the writing mode; and transmitting the door access card identification information to a server for storage.

3. The management method for electronic locks as claimed in claim 2, wherein the door access card identification information is transmitted to the server by one of the manager mobile device and the first lock.

4. The management method for electronic locks as claimed in claim 2, wherein the identification of the door access card by the first lock includes reading the unlocking authority and the door access card identification information in the door access card, wherein the first lock is unlocked when the first lock identifies both of the unlocking authority and the door access card identification information as being correct, and wherein the first lock remains in the locked state when the first lock identifies at least one of the unlocking authority and the door access card identification information as being incorrect.

5. The management method for electronic locks as claimed in claim 1, wherein using the first lock to write the unlocking authority of the first lock into the door access card includes writing a hardware identification information related to and stored in the first lock into the door access card, or writing the hardware identification information related to and stored in the first lock as well as a start date, a start time, an end date, and an end time of the unlocking authority into the door access card.

6. The management method for electronic locks as claimed in claim 1, wherein after the manager mobile device in the non-management mode is connected to the first lock in the identification mode, the first lock in the identification mode reads and identifies the unlocking authority of the manager mobile device in the non-management mode, wherein the first lock is unlocked when the first lock in the identification mode identifies the manager mobile device as being correct, and wherein the first lock remains in the locked state when the first lock in the identification mode identifies the manager mobile device as being incorrect.

7. The management method for electronic locks as claimed in claim 1, further comprising:

logging in a server;

connecting the door access card with a card reader at the server; and writing the unlocking authority of the selected lock into the door access card through use of an interface of the server, or cancelling the unlocking authority of the selected lock from the door access card through use of the interface of the server.

8. A management method for electronic locks, comprising:

obtaining a manager mobile device with management authorities of a first lock and a second lock, entering the manager mobile device in a management mode interface;

connecting the manager mobile device entered in the management mode interface with one of the first and the second locks in an identification mode;

using the manager mobile device to select at least one of the first and second locks as a lock whose unlocking authority is to be granted, with the selection being carried out through the management mode interface;

outputting a writing command from the manager mobile device to the one of the first and second locks connected to the manager mobile device, wherein the one of the first and second locks enters a writing mode after receiving the writing command;

connecting a door access card with the one of the first and second locks in the writing mode;

using the one of the first and second locks in the writing mode to write at least one of the unlocking authority of the first lock and the unlocking authority of the second lock into the door access card, granting at least one of the unlocking authorities of the first and second locks to the door access card;

disconnecting the manager mobile device from the one of the first and second locks in the writing mode, with the manager mobile device exiting the management mode interface and entering a non-management mode;

disconnecting the door access card from one of the first and second locks, with the one of the first and second locks switching from the writing mode to an identification mode;

connecting the door access card with the one of the first and second locks in the writing mode in the identification mode, wherein the one of the first and second locks is unlocked when the one of the first and second locks in the writing mode identifies the door access card as being correct, and wherein the one of the first and second locks remains in a locked state when the one of the first and second locks in the writing mode identifies the door access card as being incorrect;

using the manager mobile device entering the management mode interface to select at least one unlocking authority of a to-be-canceled door access card, wherein the selected at least one unlocking authority of the to-be-canceled door access card is to be canceled;

connecting the manager mobile device with the one of the first and second locks in the identification mode, with the manager mobile device outputting an unlocking authority-cancelling command related to the selected at least one unlocking authority of the to-be-canceled door access card to the one of the first and second locks in the identification mode, and with the one of the first and second locks in the identification mode switching to the writing mode after receiving the unlocking authority-cancelling command;

connecting the to-be-canceled door access card to the one of the first and second locks in the writing mode;

using the one of the first and second locks in the writing mode to cancel the selected at least one unlocking authority from the to-be-canceled door access card;

disconnecting the one of the first and second locks in the writing mode from the manager mobile device and the door access card whose unlocking authority has been canceled; and switching the one of the first and second locks to the identification mode.

9. The management method for electronic locks as claimed in claim 8, further comprising:

using the one of the first and second locks to read and store a door access card identification information of the door access card during or after writing at least one of the unlocking authority of the first lock and the unlocking authority of the second lock into the door access card in connection with the one of the first and second locks in the writing mode; and transmitting the door access card identification information to a server for storage.

10. The management method for electronic locks as claimed in claim 9, wherein the identification of the door access card by the one of the first and second locks includes reading the unlocking authority and the door access card identification information in the door access card, wherein the one of the first and second locks is unlocked when the one of the first and second locks identifies both of the unlocking authority and the door access card identification information as being correct, and wherein the one of the first and second locks remains in the locked state when the one of the first and second locks identifies at least one of the unlocking authority and the door access card identification information as being incorrect.

11. The management method for electronic locks as claimed in claim 9, wherein the door access card identification information of the door access card granted with at least one of the unlocking authority of the first lock and the unlocking authority of the second lock is transmitted to the server by one of the manager mobile device and the one of the first and second locks.

12. The management method for electronic locks as claimed in claim 9, wherein each of the first and second locks stores a first hardware identification information of the first lock and a second hardware identification information of the second lock, wherein the first hardware identification information is different from the second hardware identification information, wherein while the one of the first and second locks is writing at least one of the unlocking authorities of the first and second locks into the door access card, the one of the first and second locks writes at least one of the first and second hardware identification informations of the first and second locks into the door access card.

13. The management method for electronic locks as claimed in claim 8, wherein a first hardware identification information of the first lock and a second hardware identification information of the second lock are stored in a server, wherein when the one of the first and second locks connected to the manager mobile device does not include one of the first and second hardware identification informations of the selected lock whose unlocking authority is to be granted, the manager mobile device is connected to the server to obtain the one of the first and second hardware identification informations of the selected lock, wherein the writing command outputted by the manager mobile device includes the one of the first and second hardware identification informations of the selected lock, and wherein writing the unlocking authority into the door access card includes writing the one of the first and second hardware identification informations of the selected lock into the door access card.

14. The management method for electronic locks as claimed in claim 8, wherein after the manager mobile device in the non-management mode is connected to the one of the first and second locks in the identification mode, the one of the first and second locks in the identification mode reads and identifies the unlocking authority of the manager mobile device in the non-management mode, wherein the one of the first and second locks is unlocked when the one of the first and second locks in the identification mode identifies the manager mobile device as being correct, and wherein the one of the first and second locks remains in the locked state when the one of the first and second locks in the identification mode identifies the manager mobile device as being incorrect.

15. The management method for electronic locks as claimed in claim 8, further comprising:

logging in a server;

connecting the door access card with a card reader at the server; and writing the unlocking authority of the selected lock into the door access card through use of an interface of the server, or cancelling the unlocking authority of the selected lock from the door access card through use of the interface of the server.

16. The management method for electronic locks as claimed in claim 8, wherein using the one of the first and second locks to write at least one of the unlocking authorities of the first and second locks into the door access card includes writing at least one of the first and second hardware identification informations stored in at least one of the first and second locks into the door access card, or writing at least one of the first and second hardware identification informations stored in at least one of the first and second locks into the door access card as well as a start date, a start time, an end date, and an end time of the unlocking authority of at least one of the first and second locks into the door access card.

* * * * *